United States Patent [19]

Tao

[11] 4,374,018

[45] Feb. 15, 1983

[54] METHOD FOR PRODUCING UPGRADED PRODUCTS FROM A HEAVY OIL FEED

[75] Inventor: John C. C. Tao, Perkiomenville, Pa.

[73] Assignee: Air Products and Chemicals, Inc., Allentown, Pa.

[21] Appl. No.: 255,877

[22] Filed: Apr. 20, 1981

[51] Int. Cl.[3] ..... C10G 47/04; C10G 47/22

[52] U.S. Cl. ..... 208/112; 208/107; 208/126; 208/127; 423/496

[58] Field of Search ..... 208/109, 126, 112, 127; 423/496

[56] References Cited

U.S. PATENT DOCUMENTS

| | | | |
|---|---|---|---|
| 2,556,514 | 6/1951 | Bergstrom | 208/148 |
| 2,861,943 | 11/1958 | Finneran et al. | 208/76 |
| 2,894,897 | 7/1959 | Post | 208/111 |
| 2,913,396 | 11/1959 | Johnson et al. | 208/107 |
| 2,937,136 | 5/1960 | Moser et al. | 208/100 |
| 3,033,779 | 5/1962 | Fidelman | 208/127 |
| 3,202,603 | 6/1965 | Keith et al. | 208/107 X |
| 3,811,916 | 5/1974 | Russell et al. | 423/496 X |
| 3,904,494 | 9/1975 | Jacobs et al. | 204/67 |
| 4,105,752 | 8/1978 | Becker et al. | 423/496 |
| 4,182,947 | 1/1980 | Gravey et al. | 423/496 X |
| 4,287,051 | 9/1981 | Curtin | 423/650 X |
| 4,289,735 | 9/1981 | Mueller et al. | 423/496 X |

*Primary Examiner*—Delbert E. Gantz
*Assistant Examiner*—G. E. Schmitkons
*Attorney, Agent, or Firm*—Geoffrey L. Chase; E. Eugene Innis; James C. Simmons

[57] ABSTRACT

Method for converting a heavy or high boiling fraction oil to separate upgraded products, namely synthetic natural gas and carbon-coated aluminum, by hydrocracking the residual oil in the presence of particulate alumina at elevated temperature and pressure. The product streams, carbon-impregnated alumina and hydrocracked gaseous products, upon purification, are each of separate value. Economics of the process are improved by integration of certain purification steps and by the provision of hydrogen, for the hydrocracking process, by recycle from separated hydrogen in the synthetic natural gas stream and from partial oxidation of an additional portion of residual oil feedstock and separated heavy aromatics from the hydrocracking unit.

8 Claims, 1 Drawing Figure

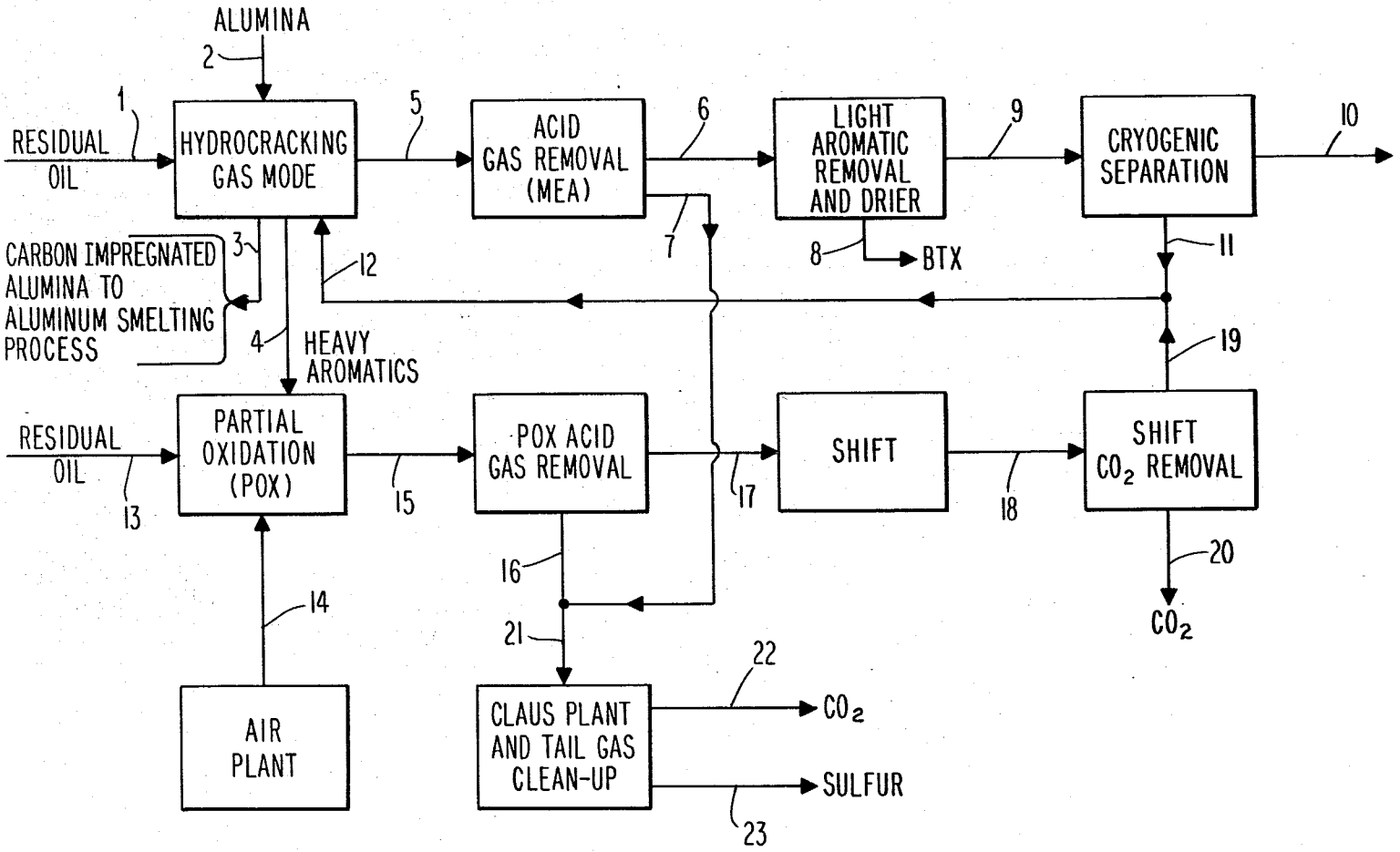
ALUMINA
2
RESIDUAL OIL
1
HYDROCRACKING GAS MODE
3
CARBON IMPREGNATED ALUMINA TO ALUMINUM SMELTING PROCESS
4
HEAVY AROMATICS
12
5
ACID GAS REMOVAL (MEA)
6
7
LIGHT AROMATIC REMOVAL AND DRIER
8
BTX
9
CRYOGENIC SEPARATION
10
11
19
RESIDUAL OIL
13
PARTIAL OXIDATION (POX)
15
POX ACID GAS REMOVAL
16
17
SHIFT
18
SHIFT $CO_2$ REMOVAL
20
$CO_2$
AIR PLANT
14
21
CLAUS PLANT AND TAIL GAS CLEAN-UP
22
$CO_2$
23
SULFUR

METHOD FOR PRODUCING UPGRADED PRODUCTS FROM A HEAVY OIL FEED

TECHNICAL FIELD

This invention pertains to a method for converting heavy crude oil, or a heavy fraction thereof, such as vacuum bottom residue, referred to generally herein as residual oil fractions, into dissimilar upgraded products. More particularly, it pertains to such a process for producing such products through a somewhat simpler process than has heretofore been proposed.

BACKGROUND OF PRIOR ART

Production of pure aluminum by electrolysis of aluminum chloride, in turn produced by conversion of carbon-coated alumina particles, is well known; U.S. Pat. Nos. 3,811,916—Russell et al and 3,904,494—Jacobs et al. The Russell et al patent teaches specifically the production of such carbon-coated alumina particles by fluid bed cracking and prior or concurrent deposition of crackable hydrocarbons on particulate alumina. For this purpose, Russell et al indicates that normally liquid hydrocarbons are preferred and fuel oil, such as No. 6 fuel oil and commercial Bunker C fuel oil, are economically preferred types thereof. This process is carried out, according to the Russell et al patent, in a two-stage fluid bed process, so as first to coat alumina particles with crackable hydrocarbon and then separately to crack the crackable hydrocarbon both in vapor and deposited form in the presence of the alumina particles. Gaseous effluent, presumably containing some cracked light hydrocarbon gases and hydrogen may be recovered and used as fuel or fluidizing gas in the process.

Other processes are also well known wherein hydrocarbon compositions, including crude oil and crude oil fractions, are thermally cracked in the presence of particulate alumina, as shown for example in U.S. Pat. Nos. 2,556,514—Bergstrom; 2,894,897—Post; and 2,937,136—Moser, Jr. Carbon deposits on the alumina particles in such processes are a common factor, dealt with for example by stripping and/or burning off the carbon from the alumina with steam. As suggested in the Post patent, the coke-coated alumina may be reacted with steam to produce hydrogen which is recycled to the cracking stage, effectively to hydrocrack the hydrocarbons there.

U.S. Pat. Nos. 2,861,943—Finneran et al; 2,913,396—Johnson et al; 3,033,779—Fidelman; and 3,202,603—Keith et al, all assigned to Hydrocarbon Research, Inc., pertain to such a process wherein the hydrocracking, at high temperature and high pressure, is integrated, such as in a single shell reactor with multiple stages of fluidization and reaction therein, with the alumina particle reaction and conversion to produce the hydrogen-containing atmospheres for hydrocracking. For purposes of comparison to the present invention, it should be noted that the Keith et al patent specifically deals with a high boiling point feedstock, such as a residual oil fraction, and suggests converting it primarily to high value gaseous products, comparable what is referred to herein as synthetic natural gas.

Notwithstanding this prior art, there remains a need for more efficiently converting high boiling point hydrocarbon fractions, such as residual oil fractions of crude oil, typified by vacuum still bottom residue, or heavy crude oil per se, such as Boscan crude, into upgraded products. Particularly, there remains a continuing need for producing such upgraded products in a simplified manner to enhance the cost effectiveness of such processes.

It is therefore the general object of the present invention to provide such a process.

BRIEF DESCRIPTION OF THE INVENTION

This objective is met, in accordance with the present invention, by a method for converting a heavy oil feed, such as a residual oil fraction, in a high temperature, high pressure hydrocracking process, into primarily synthetic natural gas, producing necessary hydrogen by conversion of a fraction of the residual oil feedstock, and producing as a separate product, carbon-coated alumina useful, for example, for conversion to aluminum chloride and thence to pure aluminum.

Preferably, the process of this invention comprises cracking the heavy oil at 1200°-1600° F., 300-700 psia total pressure, and 50-200 psia partial pressure hydrogen, with a residence time of 1 to 30 seconds in a fluid bed reactor. To maximize production of light aromatic products, less severe process conditions, in the ranges 1200°-1300° F., 500-600 psia and residence time of 5-10 seconds, are preferred.

The feedstock for this process may be any heavy oil or residual fraction from common crude oil. Even naturally occurring heavy crudes, such as Boscan crude, and Monagas crude, may be treated directly in this process.

This invention may be better understood by reference to the detailed description thereof which follows, taken in conjunction with the accompanying FIGURE and the appended claims.

BRIEF DESCRIPTION OF THE FIGURE

The accompanying FIGURE is a block diagram of various process stages of the present invention, as utilized in the preferred embodiment thereof.

DETAILED DESCRIPTION OF INVENTION

With reference to the FIGURE, the present invention, in its preferred embodiment, comprises contacting residual oil stream 1 with alumina particles 2 in a reactor, preferably a fluid bed reactor, at a temperature of 1400° F. and 600 psig total, 150 psig partial pressure hydrogen. At these conditions, three product streams are removed, namely a carbon impregnated alumina particle stream 3, suitable for conversion to aluminum chloride and electrolytic production of aluminum therefrom in accordance with conventional processing, a heavy aromatics stream 4, suitable for partial oxidation to produce hydrogen, and a light hydrocarbon and byproducts stream 5.

In accordance with conventional processes, light hydrocarbon stream 5 is subject to acid gas removal, such as by extraction (with monoethanol amine) to produce a purified stream 6, from which a light aromatics (BTX, benzene, toluene and xylene) stream 8, is removed to produce an aromatic free stream 9, which is separated by cryogenic separation into a synthetic natural gas stream 10 (which may include some $C_2$ and $C_3$ components) and a hydrogen stream 11.

The extraction stream 7 from the acid gas removal process is further processed as part of stream 21 in a Claus plant and tail gas clean-up unit for conversion of sulfur contaminants therein to sulfur, stream 23 and removal of $CO_2$, stream 22.

Hydrogen, for maintenance of the hydrogen atmosphere in the reactor in which residual oil stream 1 and alumina 2 are contacted, is produced, in addition to that separated by cryogenic separation from synthetic natural gas stream 10 as hydrogen stream 11, by partial oxidation of an additional amount of residual oil, stream 13 and heavy aromatics, stream 4 from the hydrocracking unit, with an oxygen stream 14 from a conventional air purification plant. The synthesis gas 15 from the partial oxidation step is treated to remove $CO_2$ and $H_2S$ in stream 16 and combined with stream 7 to form stream 21. The $H_2S$ is converted to elemental sulfur 23 in the Claus plant and the $CO_2$ stream 22 is vented. Acid gas free stream 17 is then subjected to a conventional shift reaction to produce a CO, $H_2$, $CO_2$ stream 18, from which is separated a $CO_2$ off-gas stream 20. The carbon monoxide-hydrogen stream 19 which remains is then recycled, together with by-product hydrogen stream 11 to the hydrocracking reaction unit.

By way of example, the illustrated process may be utilized to convert 35,000 barrels per day of residual oil to about 150 million standard cubic feet per day high BTU value synthetic natural gas and 9,300 tons per day coked alumina particles, the coke comprising about 20% by weight of the solid product. The stream flow rates in this process as calculated, are set forth in the Table which follows, in which the streams are identified as numbered in the FIGURE.

TABLE

| | 1 LB/HR | 2 LB/HR | 3 LB/HR | 4 LB/HR |
|---|---|---|---|---|
| $H_2$ | | | 3,494 | |
| $CH_4$ | | | | |
| $C_2H_6$ | | | | |
| $C_3H_8$ | | | | |
| BTX | | | | |
| Heavy Aromatics | | | | 51,496 |
| Coke | | | 139,818 | |
| Alumina | | 623,974 | 623,974 | |
| Oil | 489,504.4 | | | |
| $H_2S$ | | | | |
| S | 25,763.4 | | 9,481 | 3,401 |
| Aromatics | | | | |
| | 515,267.8 (34,540 B/D) | 623,974 (7,488 T/D) | 776,767 (9,321 T/D) | 54,897 (1.32 MMLB/D) |

| | 5 LB-MOL/HR | 6 LB-MOL/HR | 7 LB-MOL/HR | 8 LB-MOL/HR |
|---|---|---|---|---|
| $H_2$ | 8,455.2 | 8,455.2 | | |
| $CH_4$ | 14,527.5 | 14,527.5 | | |
| $C_2H_6$ | 1,639.8 | 1.639.8 | | |
| $C_3H_8$ | 486.8 | 486.8 | | |
| BTX | 238.3 | 238.3 | | 238.3 |
| Heavy Aromatics | | | | |
| Coke | | | | |
| Alumina | | | | |
| Oil | | | | |
| $H_2S$ | 402.6 | | 402.6 | |
| S | | | | |
| Aromatics | 85.6 | 85.6 | | |
| | 25,835.8 (235.0 MMSCFD) | 25,433.2 (231.3 MMSCFD) | 402.6 (3.7 MMSCFD) | 238.3 (0.46 MMLB/D) |

| | 9 LB-MOL/HR | 10 LB-MOL/HR | 11 LB-MOL/HR | 12 LB-MOL/HR |
|---|---|---|---|---|
| $H_2$ | 8,455.2 | 730.5 | 7,724.7 | 15,214.7 |
| $CH_4$ | 14,527.5 | 13,669.2 | 858.3 | 1,086.9 |

TABLE-continued

| | | | | |
|---|---|---|---|---|
| $C_2H_6$ | 1,639.8 | 1,639.7 | 0.1 | 0.1 |
| $C_3H_8$ | 486.8 | 486.8 | | |
| Aromatics | 85.6 | 21.4 | 64.2 | 85.6 |
| $H_2O$ | | | | 125.0 |
| | 25,194.9 (229.2 MMSCFD) | 16,547.6 (150.5 MMSCFD) | 8,647.3 (78.7 MMSCFD) | 16,512.3 (150.2 MMSCFD) |

| | 13 LB/HR | 14 LB-MOL/HR | 15 LB-MOL/HR | 16 LB-MOL/HR |
|---|---|---|---|---|
| $H_2$ | | | 7,332.4 | |
| CO | | | 8,382.4 | |
| $CO_2$ | | | 846.5 | 507.2 |
| $CH_4$ | | | 103.6 | |
| $H_2S$ | | | 221.4 | 221.4 |
| COS | | | 7.1 | 7.1 |
| Aromatics | | 22.3 | 21.4 | |
| $H_2O$ | | | | |
| Heavy Aromatic | | | | |
| Vacuum Residual | 128,593 | | | |
| S | 6,768 | | | |
| $O_2$ | | 4,441.5 | | |
| | 135,361 (9,074 B/D) | 4,463.8 (1,716 T/D) | 16,914.8 (153.9 MMSCFD) | 735.7 (6.7 MMSCFD) |

| | 17 LB-MOL/HR | 18 LB-MOL/HR |
|---|---|---|
| $H_2$ | 7,332.4 | 15,589.7 |
| CO | 8,382.4 | 125.0 |
| $CO_2$ | 339.3 | 8,596.6 |
| $CH_4$ | 103.6 | 103.6 |
| $H_2S$ | | |
| COS | | |
| Aromatics | 21.4 | 21.4 |
| $H_2O$ | | |
| Heavy Aromatic | | |
| Vacuum Residual | | |
| S | | |
| $O_2$ | | |
| | 16,179.1 (147.2 MMSCFD) | 24,436.3 (222.3 MMSCFD) |

| | 19 LB-MOL/HR | 20 LB-MOL/HR |
|---|---|---|
| $H_2$ | 15,214.7 | |
| CO | | |
| $CO_2$ | | 8,596.6 |
| $CH_4$ | 228.6 | |
| $H_2S$ | | |
| COS | | |
| Aromatics | 21.4 | |
| $H_2O$ | 125.0 | |
| S | | |
| | 15,589.7 (141.8 MMSCFD) | 8.596.6 (78.2 MMSCFD) |

| | 21 LB-MOL/HR | 22 LB-MOL/HR | 23 LB/HR |
|---|---|---|---|
| $H_2$ | | | |
| CO | | | |
| $CO_2$ | 507.2 | 507.2 | |
| $CH_4$ | | | |
| $H_2S$ | 624.0 | | |
| COS | 7.1 | | |
| Aromatics | | | |
| $H_2O$ | | | |
| S | | | 20,195.2 |
| | 1,138.3 (10.4 MMSCFD) | 507.2 (4.6 MMSCFD) | 20,195.2 (242 T/D |

From the foregoing, it will be appreciated that in the present process, there is a significant potential economic benefit in producing two separate useful products from a relatively low value feedstock, while avoiding the necessity of the significant separate processing steps involved in those processes where either one of the two products of the present invention represent the desired product. More specifically, in prior processes wherein carbon-coated alumina was the desired product, it was apparently deemed necessary to deposit and crack hydrocarbons in a two-stage process, in order to maximize recovery thereof. Similarly, in prior processes wherein gaseous products were produced by hydrocracking of heavy oil fractions, conversion of carbon deposited on the alumina particles was apparently deemed necessary to make the process economically attractive. The unique feature of the present invention is that by combining these processes and producing two products, separate process stages associated with the prior production of each of these two products is avoided.

While this invention has been described with reference to specific embodiments thereof, it should be understood that it is not limited thereto. Rather, the appended claims are intended to be construed to encompass not only the forms of the invention referred to and described above, but to such other variations and modifications of the invention as may be devised by those skilled in the art without departing from the true spirit and scope thereof.

I claim:

1. A method for upgrading a heavy oil feed and producing a product synthetic natural gas and a product of carbon-coated alumina particles therefrom, comprising cracking said heavy oil in the presence of hydrogen in a particulate alumina bed at 1200°–1600° F., 300–700 psia total pressure, and 50–200 psia partial pressure hydrogen, removing from said bed carbon-coated alumina particles as a product at least a portion of which is used for the production of aluminum chloride, a heavy aromatics stream, and a light gas stream, removing from said light gas stream acid gas contaminants, light aromatics, water, and hydrogen, to produce a synthetic natural gas product, and producing hydrogen for said cracking reaction by partially oxidizing a portion of said heavy oil and said separated heavy aromatic stream to produce a synthesis gas which is treated to remove acid gas components and is shifted to increase its hydrogen content and recycling hydrogen separated from said light gas stream to said cracking reaction.

2. Method, as recited in claim 1, wherein said cracking reaction is carried out 1400° F., 600 psia total pressure and 150 psia partial pressure hydrogen.

3. Method, as recited in claim 1, wherein the feed is a naturally occurring heavy crude oil.

4. Method, as recited in claim 3, wherein the feed is Boscan or Monagas crude oil.

5. Method, as recited in claim 1, wherein said reaction is carried out in a fluid bed reactor with a residence time of 1 to 30 seconds.

6. Method, as recited in claim 5, wherein said feed oil is cracked at 1200°–1300° F., 500–600 psia, with a residence time in the fluid bed reactor of from 5 to 10 seconds.

7. Method, as recited in claim 1, wherein said heavy oil feed is a heavy residual fraction of a crude oil distillation process.

8. Method, as recited in claim 1, wherein said feed oil is vacuum still residue.

* * * * *